United States Patent [19]

Anderson et al.

[11] Patent Number: 5,014,854

[45] Date of Patent: May 14, 1991

[54] EASY OPENING GABLE TOP CARTON AND BLANK THEREFOR

[75] Inventors: Nestor A. Anderson, Parsippany, N.J.; Michael E. Walsh, Stamford, Conn.

[73] Assignee: Champion International Corporation, Stamford, Conn.

[21] Appl. No.: 548,667

[22] Filed: Jul. 5, 1990

[51] Int. Cl.[5] ..... B65D 5/54

[52] U.S. Cl. ..... 206/611; 206/621.2; 206/629

[58] Field of Search ..... 206/611, 626, 629, 621.2, 206/621.6

[56] References Cited

U.S. PATENT DOCUMENTS

| | | | |
|---|---|---|---|
| 3,186,621 | 6/1965 | Svensson | 206/621.2 |
| 3,319,868 | 5/1967 | Huang et al. | 206/631.3 |
| 3,334,799 | 8/1967 | Crawford | 206/631.3 |
| 3,869,078 | 3/1975 | Braun | 206/621.2 |
| 4,362,245 | 12/1982 | Kuchenbecker | 206/629 |
| 4,520,929 | 6/1985 | Lisiecki | 206/605 |
| 4,657,143 | 4/1987 | Forbes, Jr. | 206/626 |
| 4,732,275 | 3/1988 | Hambleton et al. | 206/611 |
| 4,887,718 | 12/1989 | Anderson et al. | 206/611 |

*Primary Examiner*—Gary E. Elkins

*Attorney, Agent, or Firm*—Evelyn M. Sommer

[57] ABSTRACT

A gable top carton is provided with a flat top wall to facilitate stacking of the carton during storage and transportation. The carton is formed from a single blank of paperboard material provided with an array of score lines to facilitate the folding of various panels formed thereon into the erected carton. The top wall of the flat topped carton includes arrays of perforations disposed therein to define an integral tear strip that is selectively separable from the remainder of the carton. Removal of the tear strip enables panels of the top wall to be rotated upwardly and away from one another to define a unitary pour spout. The pour spout may be repeatedly closed and reopened to provide access to the pourable material as needed.

10 Claims, 2 Drawing Sheets

EASY OPENING GABLE TOP CARTON AND BLANK THEREFOR

BACKGROUND OF THE INVENTION

Gable top cartons are widely employed for storing liquids and other flowable materials. The typical prior art gable top carton is formed from a unitary blank of paperboard material having a plurality of score lines about which the blank is folded to form the carton.

The typical prior art gable top carton includes a square bottom wall. Four substantially identical rectangular side walls are consecutively connected to one another and are connected to and extend upwardly from the bottom wall.

The top of the typical prior art gable top carton includes a pair of rectangular roof panels which are articulated to an opposed pair of parallel side walls. The rectangular roof panels converge toward one another to meet along top seal panels. The rectangular roof panels are connected to one another by an interconnected array of triangular panels. More particularly, each array of triangular panels at the top of the prior art gable top carton comprises an isosceles triangular pour panel which is articulated to a side wall panel and a pair of triangular web panels which extend between one equal side of the isosceles triangular pour panel and one of the rectangular roof panels. In the sealed condition of the prior art gable top carton, the opposed pour panels converge generally toward one another. Additionally, in the sealed condition of the prior art gable top carton, the triangular web panels are disposed in substantially face-to-face relationship with the associated rectangular roof panel.

One end of the gable top on the typical prior art gable top carton is securely and substantially permanently sealed. However, the opposed end of the gable top on the typical prior art gable top carton is sealed with a carefully applied pattern of adhesives and adhesives to enable selective opening of the gable top. The opening is achieved by rotating the web panels and the adjacent corners of the rectangular roof panels away from one another such that the pour panel can be folded outwardly to pour a flowable material from the prior art gable top carton. The prior art carton can then selectively be reclosed.

The prior art gable top cartons are most widely employed for flowable liquids. However, they have also been used for nonliquid flowable materials, including detergents and small flowable food products, such as cereal, candies, snack foods and pet foods.

Although the above described prior art gable top cartons are extremely functional, the converging roof panels render the cartons poorly suited for the stacking that is required for efficient use of retail display space. The inability to achieve stacking in retail displays has limited the market growth of gable top cartons for nonliquid materials.

Some prior art cartons of gable top construction have been provided with substantially flat tops. This has been achieved, for example, by providing rectangular roof panels having a very short distance as measured from the respective fold lines to the side walls of the carton. Thus, in the sealed condition of the carton, the rectangular roof panel, the pour panels and the triangular web panels all are in generally face-to-face relationship with one another and defining a plane extending generally perpendicular to the side walls of the carton. The seal panels which connect the rectangular roof panels may then merely be folded over into the same plane. Prior art gable top cartons of this general type can be opened in substantially the same manner as the above described prior art gable top cartons with pitched roofs. More particularly, these prior art flat topped gable top cartons can be opened by first rotating the seal panels upwardly and away from the plane of the top of the carton. A pair of the triangular web panels and adjacent portions of the rectangular roof panels can then be rotated away from one another such that the pour panel is rotated outwardly to define a pour spout for the prior art carton. The flowable material stored in the carton can then be poured in substantially the same manner as pouring a liquid from the more conventional type of prior art gable top carton described above. One gable top carton of this general type with a complex arrangement of interlocked top panels is shown in U.S. Pat. No. 4,732,275 which issued to Hambleton et al on Mar. 22, 1988.

Still other prior art gable top cartons have been provided with a flat top wall by rotating the pour panel and the triangular web panels outwardly in generally face-to-face relationship with the side walls to which the pour panels are articulated. The pour panels may be secured in this external position after the product has been placed in the container, and may be stored or shipped in this condition. The prior art gable top carton of this type may be opened by initially rotating the pour panels away from the associated side walls of the carton. At least portions of the seals between the rectangular roof panels and the triangular web panels may then be separated or cut to provide access to the materials stored in the carton. However, the prior art means for opening this top seal has offered significant drawbacks. In short, the two step opening procedure of initially separating the pour panels from the adjacent side walls and then somehow opening or cutting the seal has been perceived as difficult by consumers.

In view of the above, it is an object of the subject invention to provide an easily openable gable top carton.

It is another object of the subject invention to provide a gable top carton that is readily stackable.

Still another object of the subject invention is to provide a unitary blank for an easily openable gable top carton having a flat top.

SUMMARY OF THE INvENTION

The subject invention is directed to a paperboard carton having a flat gable top that is efficiently openable to enable access to the material stored in the carton. The carton may include a rectangular bottom wall and four rectangular side walls consecutively articulated to one another and connected to and extending upwardly from the bottom wall. The flat top of the carton of the subject invention includes a pair of rectangular roof panels articulated to opposed substantially parallel side walls of the carton. Each rectangular roof panel extends from its respective side wall panel a distance approximately equal to one half the distance between the respective side walls. Thus the rectangular roof panels are folded toward one another and lie in nonoverlapping relationship defining a substantially flat top of the carton.

The gable top of the subject carton is further defined by a pair of pour panels articulated to the remaining opposed pair of side walls. The pour panels are of generally isosceles triangular configuration and are connected to the respective rectangular roof panels by triangular web panels which extend therebetween. The closure of the gable top of the subject carton is provided by seal panels which are articulated to the rectangular roof panels and to the triangular web panels at locations thereon most distant from the side walls of the carton. Selected areas on the seal panels may be provided with a coating to facilitate selective separation of some seal panels but not others, as explained below. The material to facilitate opening of the seal panels may be an appropriate adhesive or a silicone based printable varnish.

The gable top of the subject carton may further be characterized by opening means, and preferably a paperboard tear strip which may be integral with a seal panel articulated to one of the rectangular roof panels. The tear strip may be defined by an appropriate pattern of perforation lines to enable selective separation of the tear strip from the remainder of the seal panel. The tear strip also is provided with an appropriate anti-seal material to enable efficient separation of the tear strip from an opposed surface on the gable top as explained herein.

The blank for the carton of the subject invention includes an array of score lines to define first through fourth side wall panels and a glue panel consecutively articulated to one another along parallel fold lines. Bottom panels are articulated to each side wall panel and the glue panel along fold lines extending orthogonal to the articulations between the respective side wall panels. Rectangular roof panels are articulated to two of the side wall panels, and pour panels are articulated to the remaining two side wall panels. The rectangular roof panels are connected to the pour panels by triangular web panels. Top seal panels are articulated to portions of the rectangular roof panels and the triangular web panels remote from the respective side wall panels. The top seal panel articulated to one of the rectangular roof panels includes an integral tear strip defined by arrays of perforations.

DETAILED DESCRIPTION OF THE PREFERRED EMBODIMENT

Figure 1:
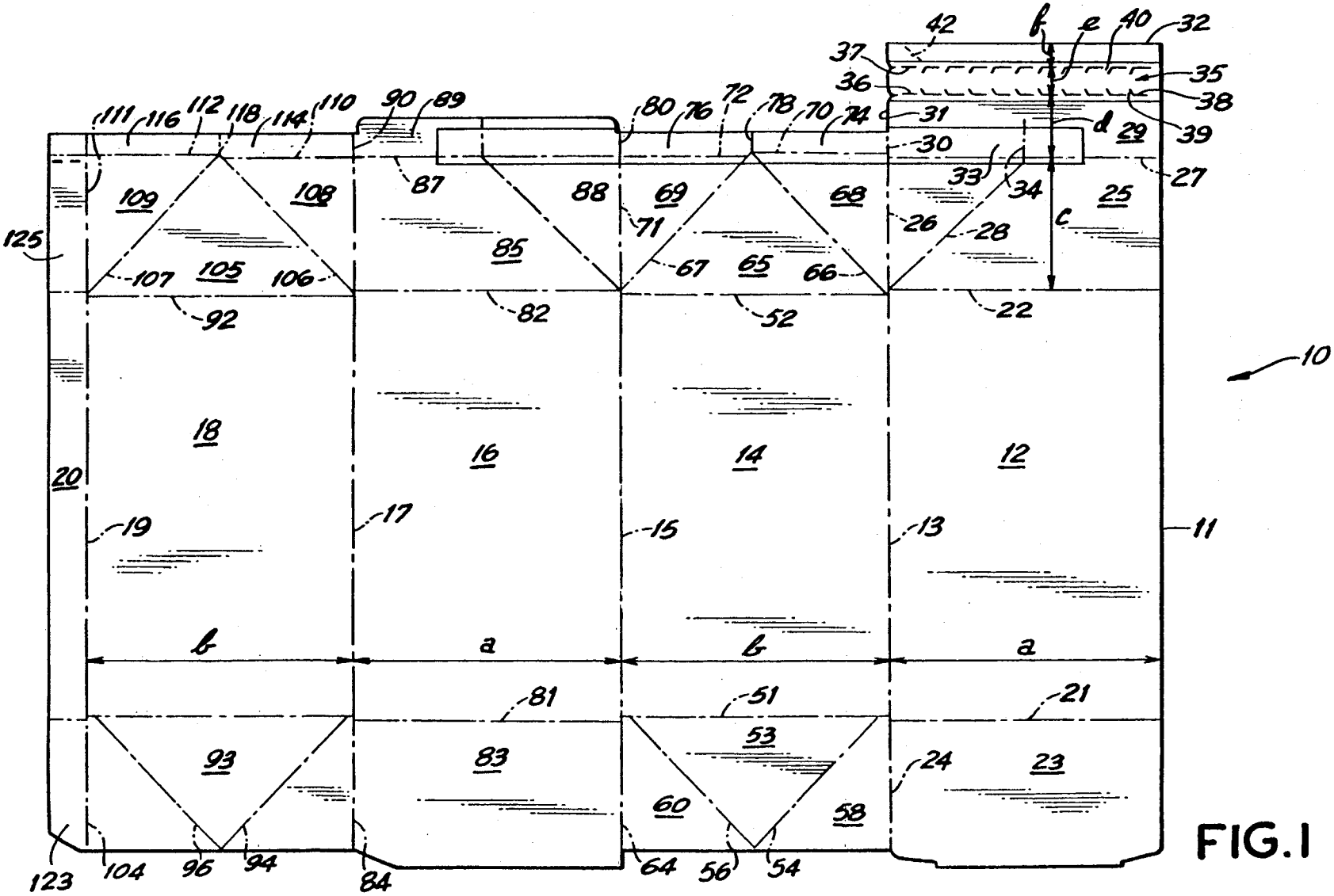
FIG. 1 is a top plan view of a blank in accordance with the subject invention.

The blank of the subject invention is identified generally by the numeral 10 in FIG. 1. The blank 10 is formed from a paperboard material that is uniformly coated with a matte finish on one planar surface and with a gloss finish on the opposed planar surface. The coatings are intended to render the carton formed from the blank 10 substantially liquid impervious. The matte finish coating will be disposed on the surface depicted in FIG. I, which will define the inner surface on the carton formed from the blank 10. Other coating or laminating arrangements are possible to render the carton sufficiently impervious to liquids.

The blank 10 is provided with an array of score lines as depicted in FIG. !, such that the blank 10 includes first through fourth side wall panels 12, 14, 16 and !8 and a side glue panel 20, which are consecutively articulated to one another along substantially parallel fold lines 13, 15, 17 and 19 respectively. The first and third side wall panels 12 and 16 are of substantially equal widths "a". The second and fourth side wall panels 14 and 18 are of substantially equal widths "b" which may be equal to width "a".

The first side wall panel 12 is further defined by edge 11 of the blank 10 and by a first bottom fold line 21 and a first top fold line 22 which extend orthogonally between the edge 11 and the fold line 13. A first bottom panel 23 is articulated to the first side panel 12 along the first bottom fold line 21. The first bottom panel 23 is further defined by fold line 24 which extends generally collinearly from the fold line 13.

A generally rectangular first top panel 25 is articulated to the first side panel 12 along the first top fold line 22. The first top panel 25 will define one of the rectangular roof panels on the top of the carton formed from the blank 10. The first top panel 25 is further defined by fold line 26 which extends generally collinearly from the fold line 13 and by fold line 27 which extends between fold line 26 and edge 11 of blank 10. The fold line 27 is generally parallel to the first top fold line 22 and is spaced distance "c" therefrom. The distance "c" is approximately equal to one-half the distance "b". The first top panel 25 also is characterized by a diagonally extending fold line 28 which extends substantially from the intersection of fold lines 22 and 26 to a point intermediate the length of fold line 27. The fold line 28 will enable a corner portion of the first top panel 25 to be folded backwardly for defining a pour spout as explained further herein.

A first top seal panel 29 is articulated to the first top panel 25 along the fold line 27. The first top seal panel 29 is further defined by fold line 30 which extends collinearly from the fold line 26, and by edge 31 which extends generally collinearly from the fold line 30 to define one side of the first top seal panel 29. The opposed side of the first top seal panel 29 is defined by the edge 11 of the blank 10. Edge 32 of the first seal panel 29 extends between edges 31 and 11 and parallel to fold line 27.

At least a portion of the first seal panel 29 extending from the fold line 30 toward the edge 11 of blank 10 is coated with an anti-seal material identified generally by the numeral 33. The anti-seal material 33 may be an approved silicone based printable varnish or any of the known adhesive materials which will provide an easily separable seal at the top of the carton formed from the blank 10. On cartons to be entirely openable in their top region, the anti-seal material 33 may extend continuously to edge 11. In the embodiment depicted in FIG. 1, however, the carton formed from the blank 10 will be only partly openable at the top to define a pour spout. To facilitate this formation of a pour spout, the first seal panel 29 is provided with a score line 34 extending from the intersection of fold lines 27 and 28 generally parallel to the edge 11 of the blank 10. The anti-seal material extends at least to the score line 34.

The first seal panel 29 further includes an integral tear strip 35 which is defined by arrays of perforations 36 and 37. It will be noted that each perforation in the arrays 36 and 37 includes a generally collinearly aligned portion 38 and an angularly aligned portion 39 which facilitate the upward pulling of the tear strip 35 during opening of the carton formed from the blank 10 as explained further below. The perforation array 36 is parallel to the fold line 27 and is distance "d" therefrom. The perforation array 37 is parallel to the perforation array 36 and is spaced distance "e" therefrom. The distance "e" defines the width of the tear strip 35 which is at least 0.50 inch wide, and preferably approximately 0.5625 inch wide. Perforation array 37 is spaced distance "f" from the edge 32 of the seal panel 29. The surface of the tear strip 35 depicted in FIG. 1 will define the inwardly facing surface on the carton formed from the blank 10. This surface of the tear strip 35 is coated with an anti-seal material 40 to facilitate the separation of the tear strip 35 from adjacent surfaces of the carton formed from the blank as explained below. Surface regions of the seal panel 29 on either side of the tear strip 35 are not coated with an anti-seal material.

The combined dimensions "d", "e", and "f" will be approximately equal to the dimension "c" as will be explained further herein. A portion of the top seal panel 29 adjacent the intersection of edges 31 and 32 is further defined by a cut line 42 aligned diagonally and extending entirely therethrough. The cut line 42 is provided to facilitate the initial flexing of paperboard material during opening of the tear strip 35 as explained below.

The second side panel 14 of the blank 10 is further defined by a second bottom fold line 51 and a second top fold line 52 which extend orthogonally between the fold lines 13 and 15 and generally parallel to but slightly offset from the fold lines 2 and 22 respectively on the first side panel 12. As noted above, the second side panel 14 defines a width "b" which generally will be equal to or less than the Width "a" of the first side panel 12.

A second bottom panel 53 is articulated to the second side panel 14 along the second bottom fold line 51. The second bottom panel 53 is of generally isosceles triangular configuration and is further defined by fold lines 54 and 56. A triangular web panel 58 is articulated to the first and second bottom panels 23 and 53 along fold lines 24 and 54 respectively. Similarly, triangular web panel 60 is articulated to the second bottom panel 53 along fold line 56. The triangular web panel 60 is further defined b fold line 64 which extends generally collinearly from the fold line 15.

A second top panel 65 is articulated to the second side panel 14 along the second top fold line 52. The second top panel 65 is of generally isosceles triangular configuration and is further defined by fold lines 66 and 67 which converge toward one another. The isosceles triangular second top panel 65 defines the pour panel for the carton erected from the blank 10.

A triangular web panel 68 is articulated to the second top panel 65 along fold line 66 and is further defined by fold line 26 and fold line 70 which extends generally parallel to the fold line 52 and between the fold lines 26 and 66. Triangular web panel 69 is articulated to the second top panel 65 along fold line 67 and is further defined by fold lines 71 and 72. The fold line 71 extends generally collinearly from the fold line 15, while the fold line 72 extends approximately collinearly from the fold line 70.

A seal panel 74 is articulated to the triangular web panel 68 along fold line 70. The seal panel 74 is further defined by fold line 30 and fold line 78. Similarly, a seal panel 76 is articulated to the triangular web panel 69 along fold line 72. The seal panel 76 is articulated to the seal panel 74 along fold line 78, and is further defined by fold line 80 which extends generally collinearly from the fold line 71. The anti-seal material 33 which had been disposed on the inner seal panel 29 extends substantially entirely across the seal panels 74 and 76 to facilitate opening of this portion of the top of the carton formed from the blank 10. It will be noted that the seal panels 74 and 76 define a width "g" which is substantially less than the width "d" defining the portion of the seal panel 29 between the fold line 27 and the perforation array 36.

The third side panel 16 is further defined by a third bottom fold line 81 and a third top fold line 82 which extend orthogonally between the fold lines 15 and 17. As noted above, the third side panel !6 defines a width "a" which is substantially equal to the width "a" of the first side panel 12.

A third bottom panel 83 is foldably connected to the third side panel 16 along the third bottom fold line 8!. The third bottom panel 83 is further defined by fold line 64 and fold line 84 which extends generally collinearly from the fold line 17.

A third top panel 85 is articulated to the third side panel 16 along the third top fold line 82. The third top panel 85 will define the other rectangular roof panel on the carton formed from the blank 10. The third top panel 85 is articulated to the triangular web panel 69 along fold line 7!. Third top panel 85 is further defined by fold line 86 which extends substantially collinearly from the fold line 17, and by fold line 87 which extends generally parallel to the fold line 82 and between the fold lines 71 and 86. Fold line 88 extends diagonally across the third top panel 85 substantially from the intersection of fold lines 71 and 82 to a point intermediate the length of fold line 87. The diagonal fold line 88 will enable the adjacent corner of the third top panel 85 to be folded back relative to the remainder of the third top panel 85 for forming the pour spout in the carton formed from the blank 10. On embodiments of the carton to have a completely openable top, the diagonal score lines 28 and 88 may not be required.

A top seal panel 89 is articulated to the third top panel 85 along fold line 87. The top seal panel 89 is articulated to the seal panel 76 along fold line 80 and is further defined by fold line 90 extending generally collinearly from the fold line 86. The width "h" of the seal panel 89 is greater than the width "g" of the seal panels 74 and 76 but less than the width "d" on the seal panel 29. The anti-seal material 33 which extends across a portion of the seal panel 29 and entirely across the seal panels 74 and 76 also extends at least partly across the seal panel 89. As shown in FIG. 1, the anti-seal material extends slightly more than halfway across the third top seal panel 89. However, on embodiments to have a completely openable top, the anti-seal material 33 may extend entirely across the third seal panel 89.

The fourth side panel 18 is further defined by a fourth bottom fold line 91 and a fourth top fold line 92 which extend orthogonally between the fold lines 17 and 19. The fourth side panel 18 defines a width "b" which is approximately equal to the width of the second side panel 14.

A fourth bottom panel 93 is articulated to the fourth side panel 18 along fourth bottom fold line 91. The fourth bottom panel 93 is of generally isosceles triangular configuration, and is further defined by converging fold lines 94 and 96. A triangular web panel 98 is hingedly connected to the fourth bottom panel 93 along fold line 94, and is further defined by the fold line 84. Similarly, a triangular web panel 100 is hingedly connected to the fourth bottom panel 93 along fold line 96. The triangular web panel 100 is further defined by fold line 104 which extends collinearly from the fold line 19.

A fourth top panel 105 is hingedly connected to the fourth side panel 18 along the fourth top fold line 92. The fourth top panel 105 is of generally isosceles triangular configuration, and is further defined by converginq fold lines 106 and 107. Triangular web panels 108 and 109 are articulated to the fourth top panel 105 along fold lines 106 and !07 respectively. The triangular web panel 108 is hingedly connected to the third top panel 85 along fold line 86. The triangular web panel 108 is further defined by fold line 110. Similarly, the triangular web panel 109 is further defined by fold line 111 which extends generally collinearly from the fold line 19, and by fold line 112 which is parallel to but slightly offset from the fold line 110.

Top seal panels 14 and 116 are hingedly connected to the triangular web panels 108 and 109 along fold lines 110 and 112. The seal panel 1!4 is connected to seal panel 89 along fold line 90, and is connected to the seal panel 116 by fold line 118. The seal panel 116 is further defined by fold line 120 which extends substantially collinearly from the fold line 111.

The side glue panel 20 is further defined by bottom and top fold lines 121 and 122 respectively which extend orthogonally from the opposed ends of fold line 19. A bottom glue panel 123 is articulated to the side glue panel 20 along fold line 121, and is articulated o the triangular web panel 100 along fold line 104. Similarly, a top glue panel 125 is articulated to the side glue panel 20 along fold line 122, and is articulated to the triangular web panel 109 along fold line 111.

Figure 2:
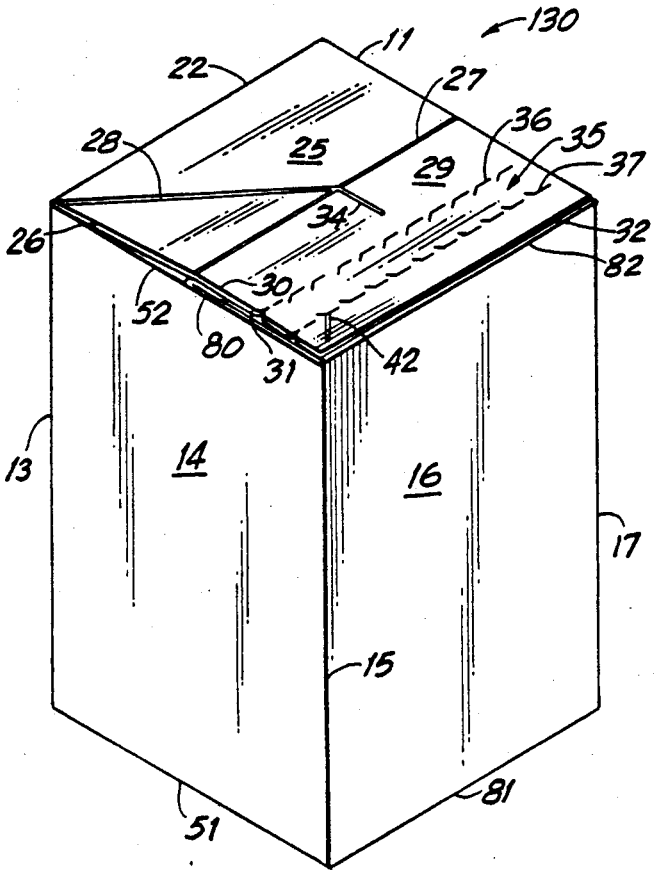
FIG. 2 is a perspective view of a sealed carton formed from the blank of FIG. 1.

The blank 10 is formed into a carton 130 as depicted in FIG. 2, by first forming the blank into a generally tubular construction with the edge 11 of the first side panel 12 being disposed substantially adjacent the fold line 19, and with the side glue panel 20 adhered in face-to-face contact with a portion of the first side panel 12 adjacent edge 11 thereof. Similarly, the bottom and top glue panels 123 and 125 are securely adhered to the first bottom panel 23 and the first top panel 25 respectively. The bottom of the carton 130 is securely closed and sealed by rotating the first through fourth bottom panels 23, 53, 83 and 93 inwardly toward one another and about the respective fold lines 21, 51, 81 and 91. The opened topped carton 130 may then be filled with an appropriate pourable material, such as a liquid or pourable solid materials which may include detergents, cereals or snack foods.

Figure 3:
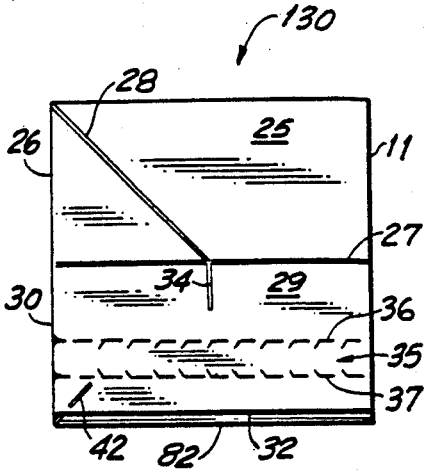
FIG. 3 is a top plan view of the carton shown in FIG. 2.

The top of the carton 130 may be closed into the form shown in FIGS. 2 and 3 by initially urging the second and fourth top panels 65 and 105 respectively inwardly about the fold lines 52 and 92 respectively. The first and third top panels 25 and 85 may then be rotated inwardly about the fold lines 22 and 82 respectively. More particularly, the first and third top panels 25 and 85 are rotated into a generally coplanar relationship to lie in a plane substantially orthogonal to the planes defined by the side wall panels 12, 14, 16 and 18. In this partly closed condition, the various top seal panels 29, 74, 76, 89, 114 and 116 will extend upwardly from the plane defined by the top panels, and with the seal panels 74, 76, 114 and 116 being disposed intermediate the seal panels 29 and 89. In this partly closed condition, the portions of the seal panels 29 and 89 having the anti-seal material 33 disposed thereon will be releasably secured to the seal panels 74 and 76 which also have the anti-seal material 33 disposed thereon.

The closure of the carton 130 proceeds by rotating the various seal panels 29, 74, 76, 89, 114 and 116 such that the top seal panel 89 is disposed in face-to-face relationship with the third top panel 85 to which the top seal panel 89 is articulated. The outer surface region of the seal panel 29 adjacent edge 32 is then securely adhered to the external region of the third top panel 85 substantially adjacent to the third top fold line 82 thereof, such that the carton 130 takes the fully sealed form depicted in FIGS. 2 and 3. It will be appreciated that in this fully sealed condition, the carton 130 has a flat top which is well suited to stacking both during storage and shipping.

Figure 4:
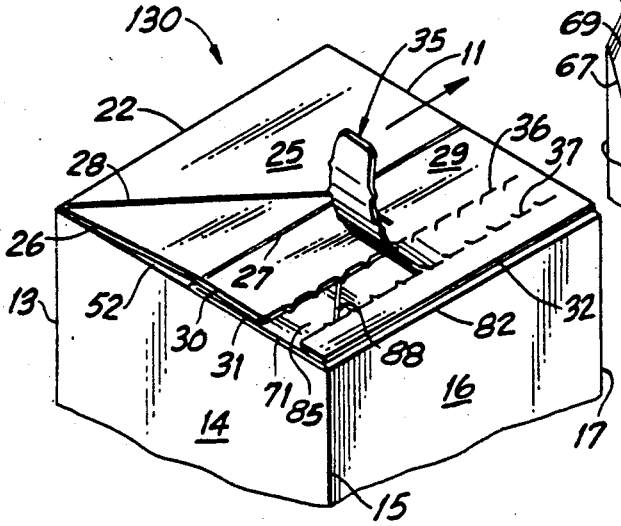
FIG. 4 is a perspective view showing the top portion of the carton in FIG. 2 during opening.
Figure 5:
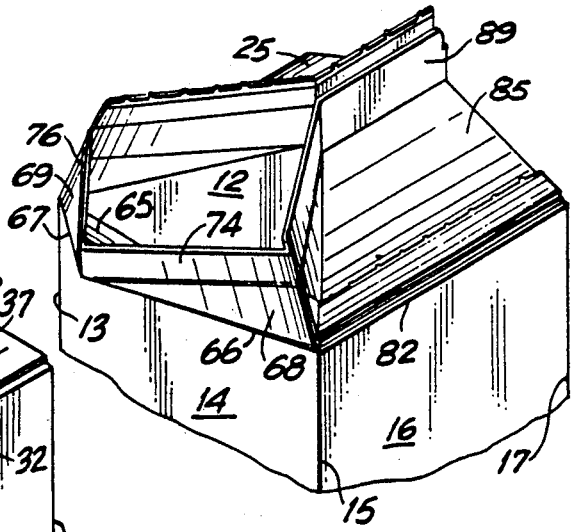
FIG. 5 is a perspective view of the carton of FIG. 2 in a fully opened condition.

The carton 130 can readily be opened by pulling on the portion of the tear strip 35 adjacent to the edge 31 of the first top seal panel 29. As shown in FIG. 4, this pulling force will cause controlled tearing of portions of the paperboard material disposed intermediate adjacent perforations in the arrays 36 and 37. Upon complete removal of the tear strip 35, the various seal panels are rotated upwardly away from the third top panel 85, and the corners of the first and third top panels 25 and 85 defined by the diagonal score lines 28 and 88 are urged away from one another to enable the outward folding of the second top panel 65 about fold line 52 to define a pour spout, as shown in FIG. 5. The carton 130 can be reclosed and reopened as needed for repeated access to the pourable material disposed therein.

In summary, a gable top carton and blank are provided. The carton has an easy opening flat top for convenient stackable storage. The carton is of generally rectangular configuration with rectangular first through fourth side walls consecutively articulated to one another along parallel fold lines. Bottom walls are articulated to each of the side walls and are folded into a planar rectangular sealed bottom wall. The first and third side walls include generally rectangular top walls articulated thereto. The second and fourth side walls include triangular top walls hingedly connected thereto. Adjacent top walls are hingedly connected to one another by triangular web panels. Seal panels are connected to the rectangular top panels and to the web panels. The seal panel articulated to the first rectangular top panel is characterized by parallel arrays of perforations to define a tear strip therebetween. Portions of the first seal panel remote from the first top panel and adjacent to the tear strip define an outer seal region which is securely attachable to a portion of the third top panel generally adjacent the third side panel, such that the carton is provided with a planar top extending substantially orthogonal to the various side walls. The carton is opened by severing the tear strip from the remainder of the top wall and subsequently rotating corners of the rectangular top panels away from one another to define a pour spout for accessing the pourable material stored in the carton. The opening of the pour spout is facilitated by selective application of an anti-seal material to selected regions of the seal panels. In certain embodiments, the entire top may be openable to provide convenient access to material stored in the carton.

While the invention has been described with respect to a preferred embodiment, it is apparent that various changes can be made without departing from the scope of the invention as defined by the appended claims.

We claim:

1. A blank for forming a gable topped carton having a flat easy opening top, said blank being formed from a single sheet of paperboard material comprising first through fourth rectangular side wall panels and a rectangular side glue panel consecutively articulated to one another along generally parallel fold lines, first through fourth bottom wall panels articulated to the first through fourth side wall panels along first through fourth bottom fold lines respectively, first through fourth top wall panels articulated to the first through fourth side wall panels along first through fourth top fold lines respectively, a top glue panel articulated to the side glue panel, the first and third top wall panels and the top glue panel being generally rectangular, the second ad fourth top wall panels being of generally isosceles triangular configuration and being further defined by converging fold lines of approximately equal length, a first triangular web panel articulated to and extending between the first and second top wall panels, a second triangular web panel articulated to an extending between the second and third top wall panels, a third triangular web panel articulated to and extending between the third and fourth top wall panels and a fourth triangular web panel articulated to and extending between the fourth top wall panel and top glue panel, top seal panels articulated respectively to the first and third top wall panels and the first through fourth triangular web panels, the top seal panel articulated to the first top wall panel including a removable tear strip integral therewith and defined by a pair of spaced apart parallel perforation arrays, and an anti-seal material disposed on at least portions of said tear strip.

2. A blank as in claim 1 wherein the distance on the first top wall panel between the first side wall panel and the seal panel articulated to the first top wall panel is approximately equal to one half the distance between the first and third side wall panels.

3. A blank as in claim 2 wherein the first top wall panel and the seal panel articulated thereto define a width a measured orthogonal to the articulation therebetween which is no greater than the distance between the first and third side wall panels.

4. A blank as in claim I comprising a first surface for defining the interior of carton formed from the blank, said first surface of said blank being provided with an anti-seal material extending substantially continuously from a selected location on the seal panel articulated to the first top panel, to a selected location on the seal panel articulated to the third top wall panel.

5. A blank as in claim I wherein the top seal panel articulated to the third top wall panel defines a width measured perpendicular to the articulation to the third top wall panel which is less than the distance between the first top wall panel and the tear strip.

6. A blank as in claim 1 wherein the tear strip extends continuously across the seal panel generally parallel to the articulation of the first top wall panel to the first side wall panel.

7. A carton formed from a unitary piece of paperboard material and having a flat easy opening gable top, said carton comprising a generally rectangular bottom wall, fist through fourth upstanding side walls consecutively articulated to one another to define a side wall enclosure extending from and connected to the bottom wall, a generally rectangular flat top comprising first through fourth top panels disposed in generally parallel relationship to one another and being hingedly connected respectively to the first through fourth side walls of the carton, a first top seal panel being articulated to the first top panel and being secured in overlying face-to-face relationship with a portion of the third top panel at a location thereon generally adjacent the third side wall, said first seal panel including a tear strip integral therewith and defined by a pair of parallel spaced part perforation lines extending entirely thereacross, said tear strip being coated with an anti-seal material whereby the tear strip is selectively separable from the remainder of the carton to facilitate opening of the gable top.

8. A carton as in claim 7 further comprising a top seal panel articulated to the third top panel, portions of the top seal panels articulated to the first and third top panels being coated with an anti-seal material to facilitate opening of the carton after removal of the tear strip therefrom.

9. A carton as in claim 7 the first and third top panels are generally rectangular and wherein the second and fourth top panels are of generally isosceles triangular configuration, triangular web panels extending consecutively between and connecting the first through fourth top panels, said first and third top panels and said triangular web panels each being provided with a top seal panel, portions of said top seal panels being provided with an anti-seal material to facilitate opening of the carton.

10. A carton as in claim 7 wherein portions of the top seal panel intermediate the tear strip and the third side wall panel are securely adhered to the top of the carton to facilitate separation of the tear strip therefrom.

* * * * *